US008894549B2

(12) United States Patent
Colledge

(10) Patent No.: US 8,894,549 B2
(45) Date of Patent: Nov. 25, 2014

(54) EXERCISE DEVICE WITH ADJUSTABLE FOOT PAD

(75) Inventor: Matthew D. Colledge, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 154 days.

(21) Appl. No.: 13/565,760

(22) Filed: Aug. 2, 2012

(65) Prior Publication Data

US 2013/0196826 A1 Aug. 1, 2013

Related U.S. Application Data

(60) Provisional application No. 61/514,816, filed on Aug. 3, 2011.

(51) Int. Cl.

| | |
|---|---|
| ***A63B 22/00*** | (2006.01) |
| ***A63B 22/06*** | (2006.01) |
| ***A63B 22/12*** | (2006.01) |
| ***A63B 22/04*** | (2006.01) |
| *A63B 21/22* | (2006.01) |

(52) U.S. Cl.

CPC ..... *A63B 22/04* (2013.01); *A63B 22/0046* (2013.01); *A63B 22/0664* (2013.01); *A63B 21/225* (2013.01); *A63B 2022/067* (2013.01); *A63B 2022/0676* (2013.01)

USPC ..... 482/52; 482/57; 482/4

(58) Field of Classification Search

USPC ..... 482/57, 52, 51, 70, 72, 54, 79, 908, 80, 482/146

See application file for complete search history.

(56) References Cited

U.S. PATENT DOCUMENTS

| | | | | |
|---|---|---|---|---|
| 5,651,754 | A * | 7/1997 | Chen | 482/57 |
| 6,106,441 | A * | 8/2000 | Chen | 482/57 |
| 6,171,216 | B1 * | 1/2001 | Wang et al. | 482/54 |
| 6,743,155 | B2 * | 6/2004 | Pan | 482/54 |
| 6,849,034 | B2 * | 2/2005 | Eschenbach | 482/52 |
| 6,945,912 | B2 | 9/2005 | Levi | |
| 7,276,017 | B2 * | 10/2007 | Chen | 482/52 |
| 7,377,879 | B1 | 5/2008 | Chen | |
| 7,563,203 | B2 * | 7/2009 | Dalebout et al. | 482/54 |
| 7,604,573 | B2 | 10/2009 | Dalebout et al. | |
| 7,665,388 | B2 | 2/2010 | Chen | |
| 7,674,205 | B2 | 3/2010 | Dalebout et al. | |
| 7,901,330 | B2 | 3/2011 | Dalebout et al. | |
| 8,801,582 | B2 * | 8/2014 | Huang et al. | 482/54 |
| 2008/0064571 | A1 * | 3/2008 | Lee | 482/52 |

* cited by examiner

*Primary Examiner* — Stephen Crow
*Assistant Examiner* — Rae Fischer
(74) *Attorney, Agent, or Firm* — Workman Nydegger Holland & Hart LLP

(57) ABSTRACT

An exercise device having a selectively adjustable footpad is disclosed. More specifically, the present invention describes a footpad whose angular orientation is adjustable by a cam having at least two support sides. The cam can be positioned between the footpad and a link arm. The cam can be rotatable about an axis with each support side being a different distance from the axis. The angle of the footpad can be adjusted by selectively rotating the cam so that the footpad is resting on different support sides of the cam.

20 Claims, 7 Drawing Sheets

EXERCISE DEVICE WITH ADJUSTABLE FOOT PAD

RELATED U.S. APPLICATIONS

This application claims priority from U.S. provisional application No. 61/514,816 filed on Aug. 3, 2011.

TECHNICAL FIELD

The present invention relates generally to exercise devices that include one or more footpads for accommodating a user's feet during the performance of an exercise. More particularly, the present invention relates to an adjustment mechanism for orienting footpads on an exercise device at different positions.

BACKGROUND

Many different exercise devices exist today that have one or more footpads for receiving and supporting the feet of a user during the performance of an exercise. The footpads in these exercise devices may reciprocate along a path or rotate about a closed loop, simulating a running, walking, striding, and/or climbing motion for the individual using the device. These machines are commonly referred to as elliptical machines, striders, and/or steppers.

The angle of a footpad on some exercise devices (e.g., striders) steppers) may remain constant as the footpad travels along its path or about its closed loop during the performance of an exercise. The angle of footpads on other exercise devices (e.g., elliptical machines) may change as the footpad travels along its path or about its closed loop during the performance of an exercise. Regardless, the position of the footpad on these exercise devices is often rigidly secured to one or more link arms on the exercise device and cannot be selectively adjusted by a user.

This lack of adjustability can be problematic, as different users may desire differing angular positions for the footpads on an exercise device. For example, individuals with flat feet, fallen arches, or other foot ailments may require the footpads on an exercise device to be at a certain position. Even absent foot ailments, different individuals may simply prefer different footpad positions. In addition, some users may prefer that the footpads on an exercise device be in one position when they are using the device at one speed (e.g., to walk) or difficulty level and at a different position when they are using the device at another speed (e.g., to run) or difficulty level. Other users may prefer different angular positions of footpads in order to target a specific muscle group.

Unfortunately, there is no simple and efficient way to vary the position of a footpad on an exercise device. Solutions that do exist often comprise complex or intricate mechanisms. However, many of these are difficult to operate at best, and are also expensive to manufacture and cumbersome to assemble.

SUMMARY OF THE INVENTION

In one aspect of the disclosure, an exercise device includes a frame, a link arm, a cam, and a footpad, or a combination of one or more of the foregoing.

In another aspect that may be combined with any of the aspects herein, the frame can have a forward end and a rearward end.

In another aspect that may be combined with any of the aspects herein, the link arm can be connected to the frame and move during the performance of an exercise by a user.

In another aspect that may be combined with any of the aspects herein, the cam may be connected to the link arm.

In another aspect that may be combined with any of the aspects herein, the cam may have at least two support sides.

In another aspect that may be combined with any of the aspects herein, the cam can further be rotatable about an axis.

In another aspect that may be combined with any of the aspects herein, the distance between the point where the axis intersects the cam and a first support side is different than the distance between the point where the axis intersects the cam and a second support side.

In another aspect that may be combined with any of the aspects herein, the footpad may receive a user's foot while the user performs an exercise on the exercise device.

In another aspect that may be combined with any of the aspects herein, the footpad can have a toe end and a heel end.

In another aspect that may be combined with any of the aspects herein, the footpad can be pivotally connected to the link arm at one end and rest on one of the at least two support sides of the cam.

In another aspect that may be combined with any of the aspects herein, the angle between the footpad and the link arm can be selectively varied by a user based on the orientation of the cam relative to the footpad.

In another aspect that may be combined with any of the aspects herein, the cam is triangular and has three support sides, and the distance between the point where the axis intersects the cam and the third support side is different from the distances between the point where the axis intersects the cam and the first and second support sides.

In another aspect that may be combined with any of the aspects herein, the cam has four support sides, and the distances between the point where the axis intersects the cam and each of the support sides is different.

In another aspect that may be combined with any of the aspects herein, the exercise device includes a knob connected to the cam that can be grasped in a user's hand to rotate the cam.

In another aspect that may be combined with any of the aspects herein, the footpad is pivotally connected to the link arm at or near the toe end of the footpad.

In another aspect that may be combined with any of the aspects herein, the footpad is pivotally connected to the link arm at or near the heel end of the footpad.

In another aspect that may be combined with any of the aspects herein, the footpad includes a support plate.

In another aspect that may be combined with any of the aspects herein, the exercise device includes a drive assembly that is mounted on the frame.

In another aspect that may be combined with any of the aspects herein, the footpads reciprocate along a fixed path or rotate about a closed loop during performance of an exercise.

In another aspect that may be combined with any of the aspects herein, the drive assembly includes a flywheel that rotates during performance of an exercise.

In another aspect that may be combined with any of the aspects herein, the drive assembly is mounted toward the forward end of the frame.

In another aspect that may be combined with any of the aspects herein, the drive assembly is mounted toward the rearward end of the frame.

In another aspect that may be combined with any of the aspects herein, the drive assembly is mounted between the forward and rearward ends of the frame.

In another aspect that may be combined with any of the aspects herein, the footpad can move in an elliptical path as the flywheel rotates about the first axis.

DETAILED DESCRIPTION OF THE PREFERRED EMBODIMENTS

In general, the present invention describes a simple and efficient way to vary the position of a footpad on an exercise device to accommodate the desires of different users, as well as the desires of individual users. More specifically, the present invention describes a footpad whose angular position is adjustable by a cam having at least two support sides. The cam can be positioned between the footpad and a link arm. The cam can be rotatable about an axis with at least two of the support sides being a different distance from the point about which the cam rotates. The orientation of the footpad can be adjusted by a user by selectively rotating the cam so that the footpad is resting on different support sides of the cam.

Unless specified or limited otherwise, the term "connected" is used broadly and encompasses both direct and indirect connections. Further, this term is not restricted to mechanical connections but also includes frictional, adhesive, magnetic and other connections.

Figure 1:
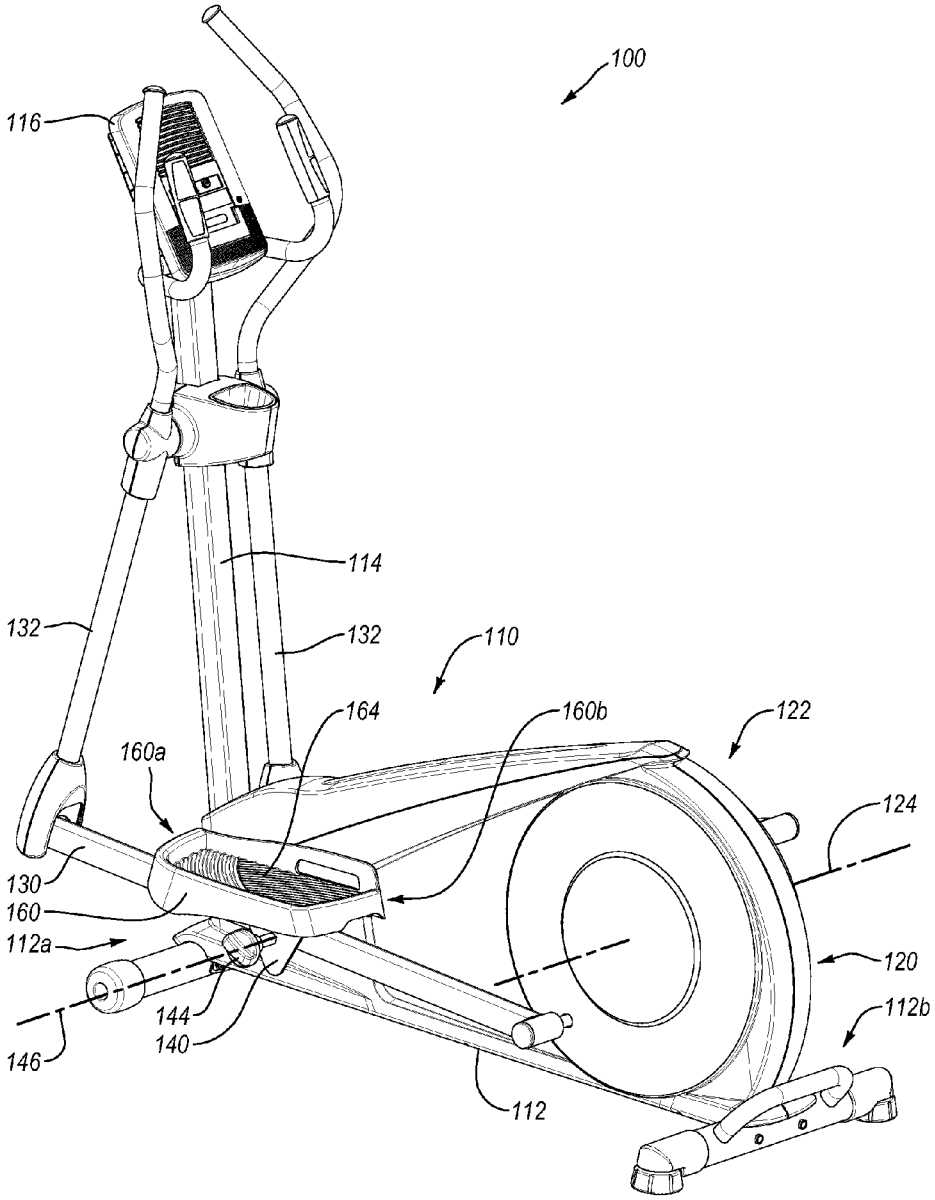
FIG. 1 illustrates a perspective view of a rear mechanism elliptical exercise device having an adjustable footpad according to the present invention.

FIG. 1 illustrates a perspective view of an exercise device 100. In the presently illustrated embodiment, exercise device 100 is an elliptical machine. Exercise device 100 comprises a frame 110, which is configured to provide both structural and translational support to the components of the exercise device 100, and also to interface with the ground. Frame 110 includes a base member 112 and an upright member 114. Upright member 114 may support a console 116. Base member 112 has a forward end 112*a* and a rearward end 112*b*.

Exercise device 100 also includes a drive assembly 120. Drive assembly 120 can enclose in whole or in part a weighted flywheel 122. Flywheel 122 rotates about an axis 124 during performance of an exercise on exercise device 100. Drive assembly 120 is mounted at or near the rearward end 112*b* of base member 112. Because of the position of the drive assembly on the frame, exercise device 100 is commonly referred to as a "rear mechanism" or "rear drive" elliptical machine. As discussed in more detail hereafter, the present invention can be used with elliptical machines having a drive assembly that is mounted at or near the forward end of the elliptical machine frame (see FIGS. 4 and 5) or somewhere between a forward end and rearward end of the elliptical machine frame (see FIG. 6).

Exercise device 100 has several link arms (e.g., 130 and 132). Link arms, according to the present invention, can be any part of an exercise device that moves during performance of an exercise on the device. For example, exercise device 100 includes at least two link arms: a foot support link arm 130 and a hand rail link arm 132. Link arms 130 and 132 are connected to frame 110. More specifically, foot support link arm 130 is rotatably attached to drive assembly 120 at one end. At its other end, foot support link arm 130 is rotatably attached to hand rail link arm 132. Hand rail link arm 132 is rotatably attached to upright member 114. Each of these link arms moves during the performance of an exercise on exercise device 100.

Exercise device 100 also includes a cam 140. Cam 140 has a triangular cross-sectional shape and includes three separate support sides, 142*a*, 142*b*, and 142*c* (see FIGS. 2A-2C). A support side, according to the present invention, can be any surface on a cam that at least partially supports a footpad and maintains that footpad in a desired position during the performance of an exercise. Cam 140 is rotatably connected to foot support link arm 130. A knob 144 is attached to cam 140 to facilitate rotation of cam 140 about an axis 146. A cam, according to the present invention, may but need not be capable of a full 360 degree rotation. Indeed, the cam may only be able to rotate 180 degrees, or less.

Figure 2A:
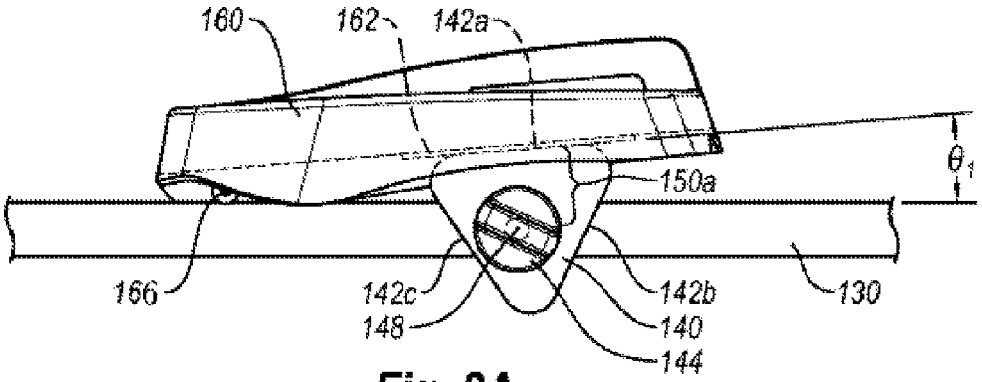
FIG. 2A illustrates a side view of a footpad from the elliptical exercise device illustrated in FIG. 1, the footpad in FIG. 2A being at a first angular position.
Figure 2B:
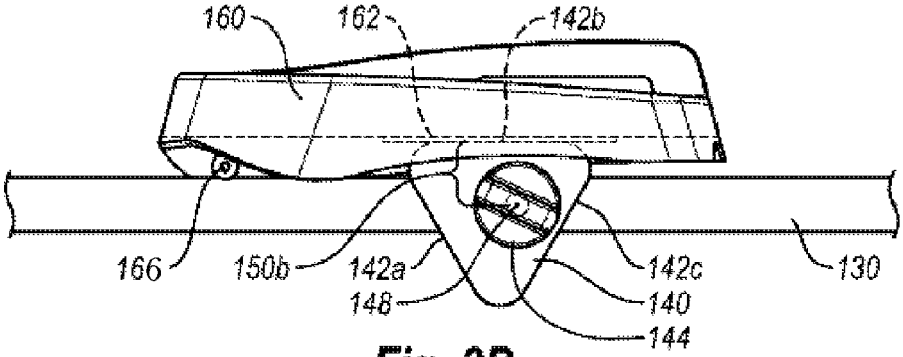
FIG. 2B illustrates a side view of a footpad from the elliptical exercise device illustrated in FIG. 1, the footpad in FIG. 2B being at a second angular position.
Figure 2C:
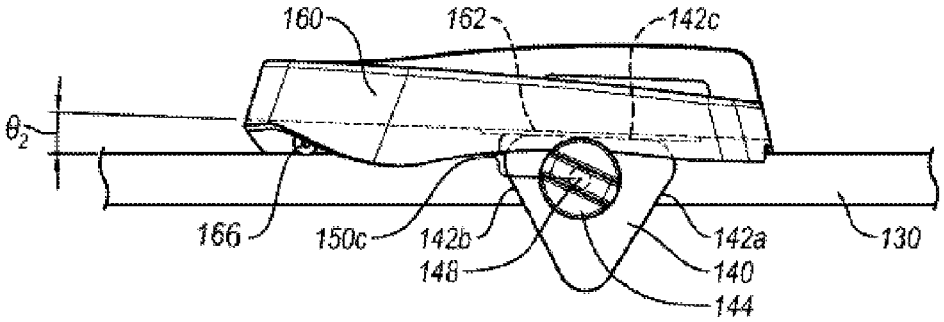
FIG. 2C illustrates a side view of a footpad from the elliptical exercise device illustrated in FIG. 1, the footpad in FIG. 2C being at a third angular position.

Axis 146 intersects cam 140 at a point 148 (see FIGS. 2A-2C) that is not equidistance from each support side. Rather, different distances separate point 148 from at least two of support side 142*a*, 142*b*, and 142*c*. For example, as can be seen in FIGS. 2A-2C, a distance 150*a* separates point 148 from support side 142*a*. A distance 150*b* separates point 148 from support side 142*b*. A distance 150*c* separates point 148 from support side 142*c*. Distance 150*a* is larger than both distances 150*b* and 150*c* and distance 150*b* is larger than distance 150*c*.

Exercise device 100 also includes a footpad 160. Footpad 160 can be sized and configured to receive and support one or both feet of a user during the performance of an exercise on exercise device 100. Footpad 160 can have a toe end 160*a* configured to receive a toe end of a user's foot and a heel end 160*b* configured to receive a heal end of a user's foot. The upper surface of footpad 160 can include a non-slip material 164 to help secure the feet of a user during performance of an exercise. During the performance of an exercise on exercise device 100, footpad 160 rotates about a closed, elliptical-shaped loop. Footpad 160 is pivotally connected to foot support link arm 130 at or near its toe end 160*a*.

Footpad 160 also interacts with cam 140. Cam 140 can be positioned at any point under footpad 160. For example, a cam can be positioned below the toe end 160*a*, the heel end 160*b*, or somewhere between the toe and heel ends 160*a*, 160*b* of footpad 160. The underside portion of footpad 160 can include a support plate 162 (illustrated in FIGS. 2A-2C). Support plate 162 interfaces with a support side 142*a-c* of cam 140 to provide a generally flat surface for cam 140 to support footpad 160. In other words, footpad 160 rests on cam 140. However, in alternative embodiments of the present invention, a footpad can be attached to a cam with a pin or clip or another device that provides a secure connection between the cam and the footpad.

FIGS. 2A through 2C illustrate the adjustability of footpad 160. FIG. 2A shows a hinge 166 pivotally connecting toe end 160a of footpad 160 to foot support link arm 130. FIG. 2A also shows cam 140 oriented such that support plate 162 of footpad 160 is resting on support side 142*a*. As can be seen, distance 150*a* separates support side 142*a* from point of rotation 148. Thus, positioning support side 142*a* below footpad 160 creates an inclining angle $\theta_1$ between footpad 160 and foot support link arm 130.

FIG. 2B shows cam 140 after a rotation of 120 degrees from its position in FIG. 2A. In FIG. 2B, cam 140 is oriented such that support plate 162 of footpad 160 is resting on support side 142*b*. As can be seen, distance 150*b* separates support side 142*b* from point of rotation 148. Footpad 160 is parallel to foot support link arm 130 when support side 142*b* is positioned below footpad 160.

FIG. 2C shows cam 140 after a rotation of 120 degrees from its position in FIG. 2B. In FIG. 2C, cam 140 is oriented such that support plate 162 of footpad 160 is resting on support side 142*c*. As can be seen, distance 150*c* separates support side 142*c* from point of rotation 148. Thus, positioning support side 142*b* below footpad 160 creates a declining angle $\theta_2$ between footpad 160 and foot support link arm 130.

Figure 3A:
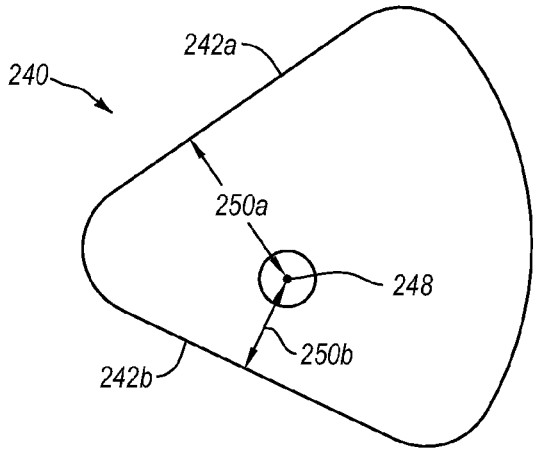
FIG. 3A illustrates a side view of a first possible cam for use with the present invention.
Figure 3B:
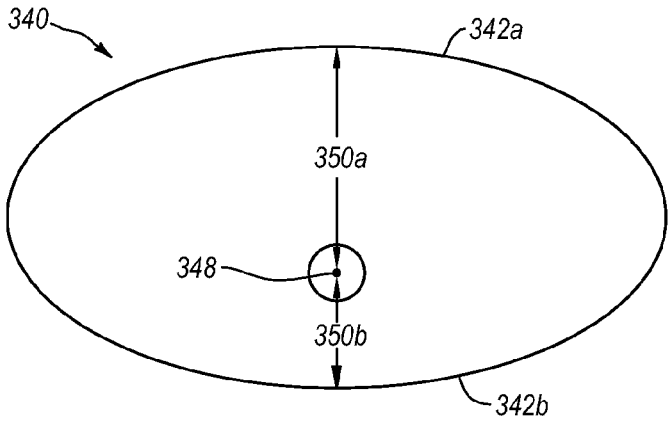
FIG. 3B illustrates a side view of a second possible cam for use with the present invention.
Figure 3C:
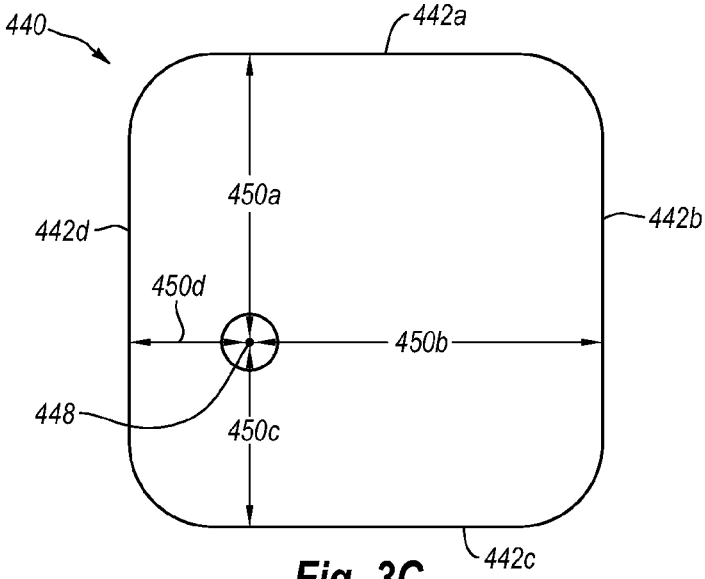
FIG. 3C illustrates a side view of a third possible cam for use with the present invention.

FIGS. 3A through 3C illustrate additional cam shapes that are possible according to the present invention. Cam 240 in FIG. 3A is generally tear-drop shaped. Cam 240 has two support sides, 242*a* and 242*b*. Support sides 242*a* and 242*b* on cam 240 are flat. A distance 250*a* separates support side 242*a* from point 248 about which cam 240 rotates. A distance 250*b* separates support side 242*b* from point 248. Distances 250*a* and 250*b* are not the same.

Cam 340 in FIG. 3B is generally oval shaped. Cam 340 has two support sides, 342*a* and 342*b*. Support sides 342*a* and 342*b* on cam 340 are curved. A distance 350*a* separates support side 342*a* from point 348 about which cam 340 rotates. A distance 350*b* separates support side 342*b* from point 348. Distances 350*a* and 350*b* are not the same.

Cam 440 in FIG. 3C is a square with rounded corners. Cam 440 has four support sides, 442*a*, 442*b*, 442*c*, and 442*d*. Each of the support sides on cam 440 is flat. A distance 450*a* separates support side 442*a* from point 448 about which cam 440 rotates. A distance 450*b* separates support side 442*b* from point 448. A distance 450*c* separates support side 442*c* from point 448. A distance 450*d* separates support side 442*d* from point 448. At least two of distances 250*a*, 250*b*, 250*c*, and 250*d* are not the same.

Figure 4:
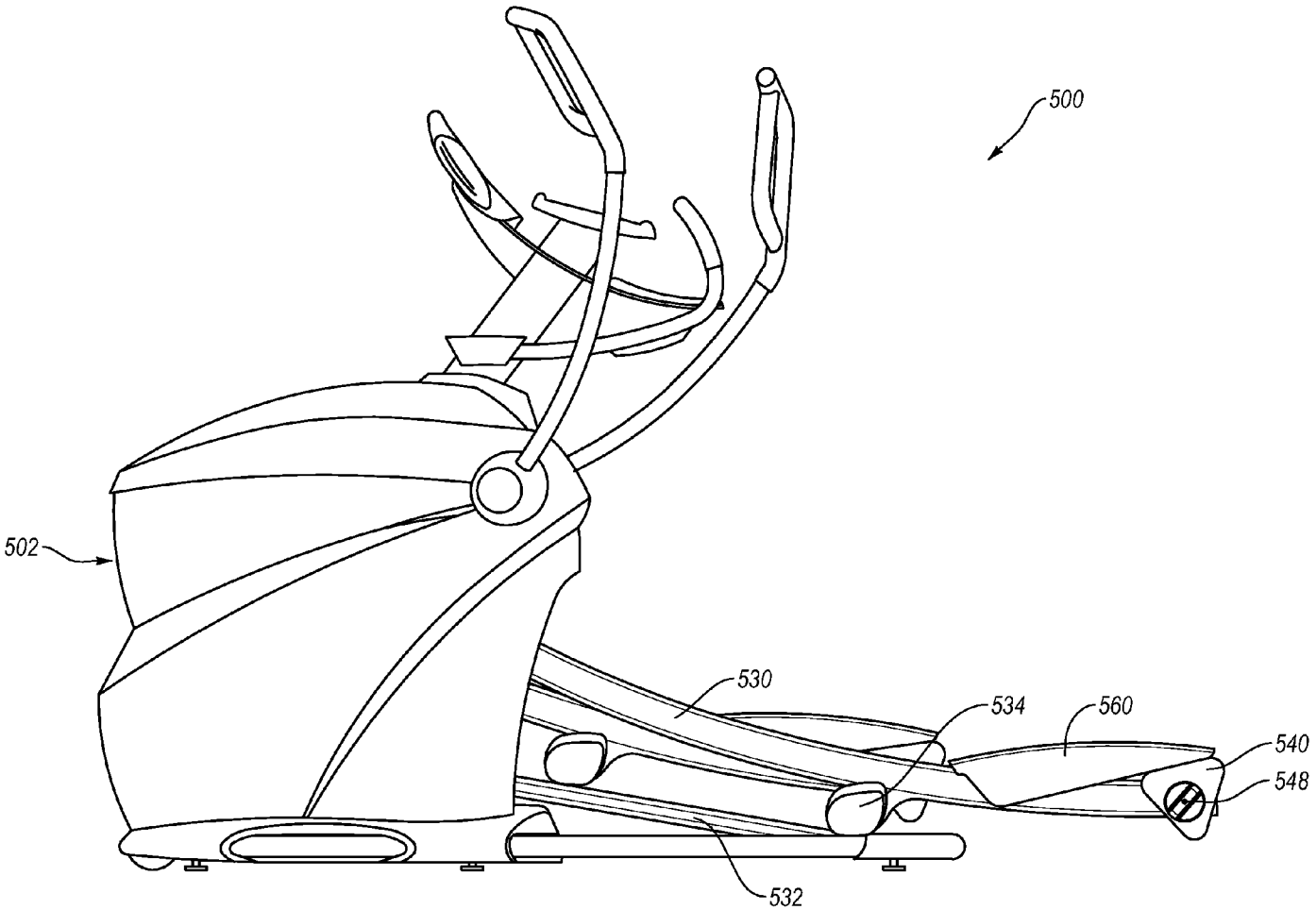
FIG. 4 illustrates a side view of a first front mechanism elliptical exercise device having an adjustable footpad according to the present invention.

FIG. 4 illustrates a side view of a second exercise device 500. Exercise device 500 is also illustrated as a front mechanism elliptical machine. A link arm 530 supports a footpad 560. Link arm 530 is rotatably connected to a drive assembly 520 at one end. Link arm 530 is supported by and reciprocates along support rails 532 during performance of an exercise. Rollers 534 mounted on link arms 530 provide a smooth connection between link arm 530 and support rails 532.

As can be seen in FIG. 4, part of footpad 560 rests on a cam 540, which is rotatably connected to link arm 530. Cam 540 has a number of support sides, which are not equidistant from the point 548 about which cam 540 rotates. Thus, the angle of footpad 560 is variable and depends on which support side of cam 540 is supporting footpad 560. Cam 540 may be similar or identical to the other cams described herein.

Figure 5:
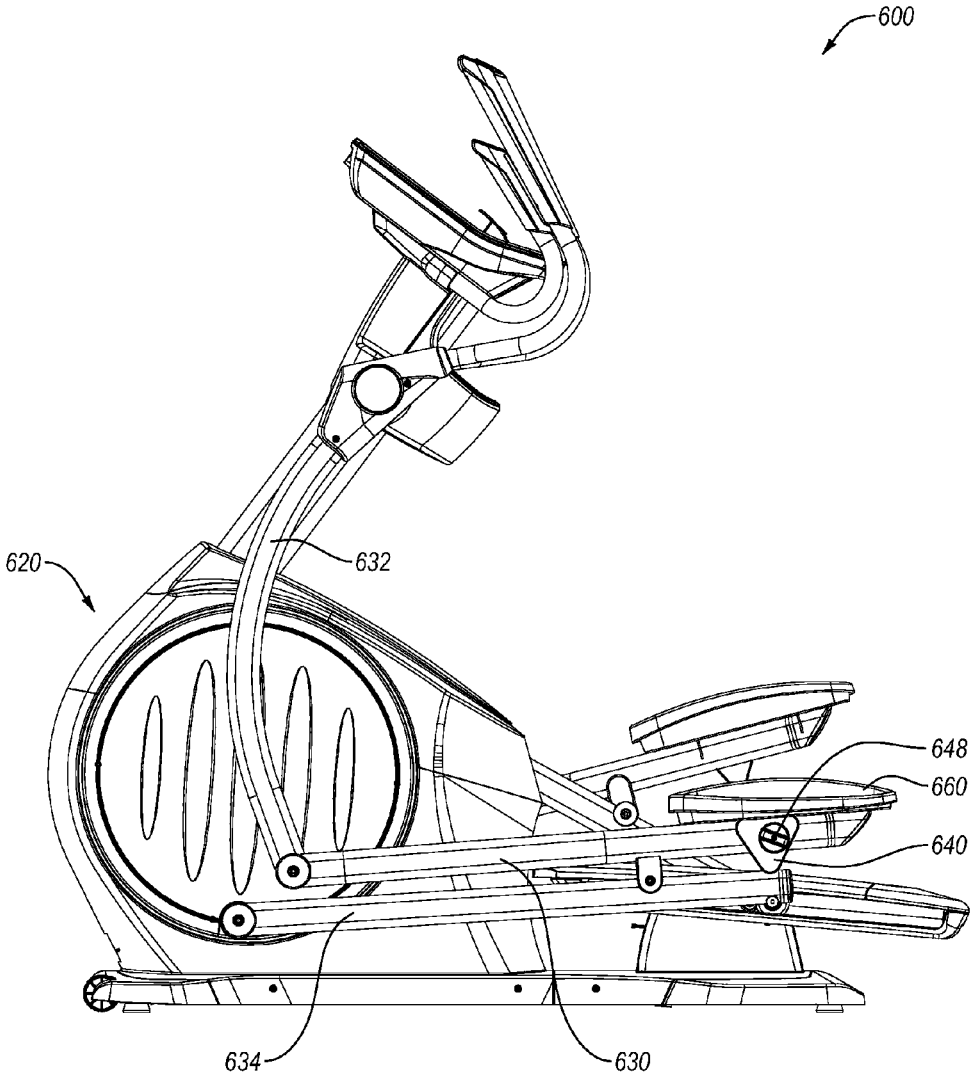
FIG. 5 illustrates a side view of a second front mechanism elliptical exercise device having an adjustable footpad according to the present invention.

FIG. 5 illustrates a side view of a third exercise device 600. Exercise device 600 is also illustrated as a front mechanism elliptical machine. A link arm 630 supports a footpad 660. Link arm 630 is rotatably connected to a second link arm 632 and drive assembly 620. Link arm 630 is also rotatably connected to a third link arm 634. Each of these link arms moves during the performance of an exercise.

As can be seen in FIG. 5, part of footpad 660 rests on a cam 640, which is rotatably connected to link arm 630. Cam 640 has a number of support sides, which are not equidistant from the point 648 about which cam 640 rotates. Thus, the angle of footpad 660 is variable and depends on which support side of cam 640 is supporting footpad 660. Cam 640 may be similar or identical to the other cams described herein.

Figure 6:
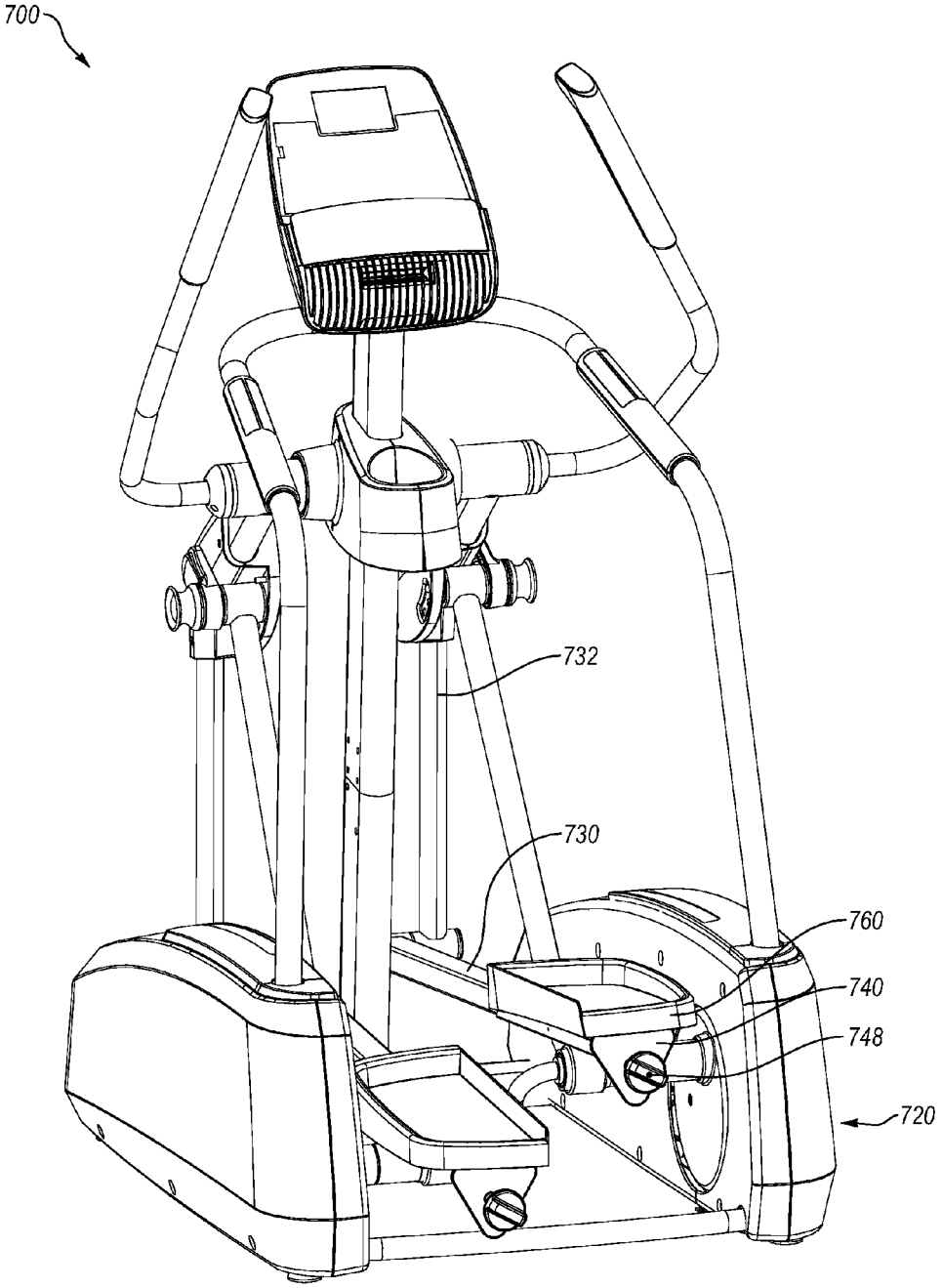
FIG. 6 illustrates a perspective view of a mid-mechanism elliptical exercise device having an adjustable footpad according to the present invention.

FIG. 6 illustrates a perspective view of a fourth exercise device 700. Exercise device 700 is illustrated as a mid-mechanism elliptical machine. A link arm 730 supports a footpad 760. Link arm 730 is rotatably connected to a second link arm 732 at one end. Link arm 730 is also connected to a drive assembly 720.

As can be seen in FIG. 6, part of footpad 760 rests on a cam 740, which is rotatably connected to link arm 730. In this embodiment, a user rotates cam 740 from the rearward end of link arm 730. Cam 740 has a number of support sides, which are not equidistant from the point 748 about which cam 740 rotates. Thus, the angle of footpad 760 is variable and depends on which support side of cam 740 is supporting footpad 760. Cam 740 may be similar or identical to the other cams described herein.

Figure 7:
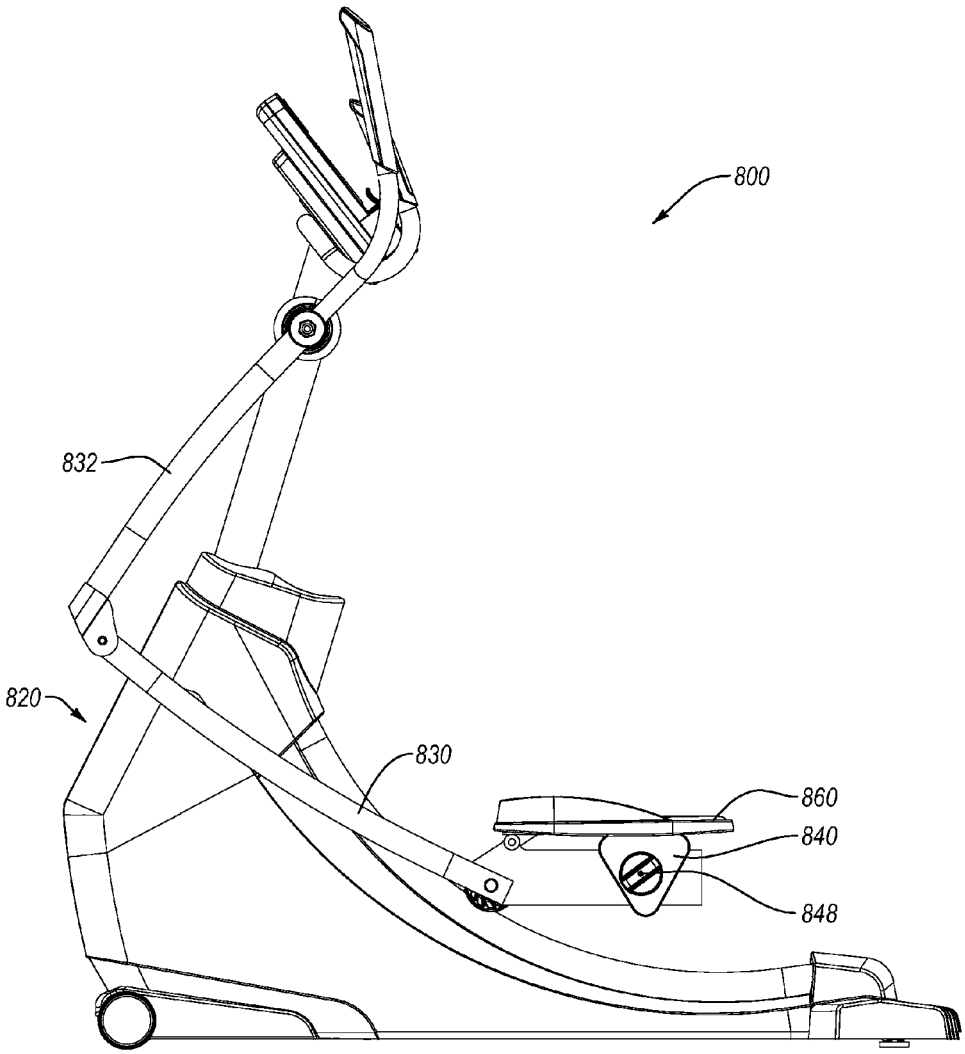
FIG. 7 illustrates a side view of a strider exercise device having an adjustable footpad according to the present invention.

FIG. 7 illustrates a side view of a fifth exercise device 800. Exercise device 800 is illustrated as a strider exercise machine. A link arm 830 supports a footpad 860. Link arm 830 is rotatably connected to a second link arm 832 and to a drive assembly 820. Link arm 830 moves during the performance of an exercise.

As can be seen in FIG. 7, a part of footpad 860 rests on a cam 840, which is rotatably connected to link arm 830. Cam 840 has a number of support sides, which are not equidistant from the point 848 about which cam 840 rotates. Thus, the angle of footpad 860 is variable and depends on which support side of cam 840 is supporting footpad 860. Cam 840 may be similar or identical to the other cams described herein Industrial Applicability In general, the present invention relates to an adjustment mechanism for selectively changing the position of a footpad on an exercise device. The adjustment mechanism described in the present invention is versatile, simple to make and use, can accommodate a large number of different positional settings, and is inexpensive to manufacture.

The mechanism for varying the position of a footpad disclosed herein can be used with nearly any exercise device that includes one or more footpads to support a user's feet during performance of an exercise. Several of these exercise devices are identified herein (i.e., ellipticals, striders, steppers); however, the mechanism disclosed herein can be used with other exercise devices having footpads. For example, some strength machines have one or more footpads that may be linked by a cable or pulley system to a weight stack. The mechanism disclosed herein could also be applied to this type of a strength machine to selectively adjust the position of the footpad. In alternative embodiments, a footpad can be pivotally connected to a supporting structure at or near its toe end or at or near its heal end.

The mechanism for varying the position of a footpad disclosed herein is simple to use. Adjusting a footpad using the mechanism disclosed herein may only require a user to rotate a knob or push a button. The knob or button for adjusting the position of a footpad can be located somewhere convenient and easily reachable by a user. The knob can be accessible on either side of a link arm. Alternatively, the knob may be positioned at an end of a link arm. In other embodiments of the present invention, a motor may be used to rotate a cam. In these embodiments, the motor may be activated by pressing a button located on the console or elsewhere on the exercise device.

The mechanism for varying the position of a footpad disclosed herein can also accommodate a large number of different positional settings. For instance, the mechanism may include a cam that is circular, oval, or polygonal with any number of support sides. The support sides can be flat or curved. Further the transition between two support sides on a cam may be sharp or rounded. The number of support sides on a cam that are not equidistant from the cam's rotational axis will determine the number of different possible positions for a footpad.

A cam may be rotatably connected to a footpad instead of a link arm. In such an embodiment, the support sides of a cam could rest on the link arm to which the footpad is pivotally connected. To change the angular position of the footpad in this embodiment, the cam could be selectively varied by a user based on the orientation of the cam relative to the footpad.

The mechanism for varying the angle of a footpad disclosed herein is easy to manufacture and inexpensive to produce. The mechanism for varying the angle of a footpad disclosed herein does not involve a large number of different moving parts, which can increase manufacturing cost and complexity. The mechanism disclosed herein involves a single cam, which can be rotated about a single axis to different positions.

Not all support sides of a cam need to have different distances from the point where a rotational axis intersects the cam. For example, a cam may have three supports sides. Two of the three support sides may have the same distance to the point where a rotational axis intersects the cam, with the third support side having a different distance.

What is claimed is:

1. An exercise device with an adjustable foot pad, the exercise device comprising:

a frame having a forward end and a rearward end;

a link arm connected to the frame, the link arm being moveable during the performance of an exercise by a user;

a cam connected to the link arm, the cam having at least two support sides, the cam being rotatable about an axis, wherein the distance between the axis and a first support side is different than the distance between the axis and a second support side; and a footpad for receiving a user's foot while the user performs an exercise on the exercise device, the footpad having a toe end and a heel end, the footpad being pivotally connected to the link arm at one end and resting on one of the at least two support sides of the cam, wherein the angle between the footpad and the link arm can be selectively varied by a user based on the orientation of the cam relative to the footpad;

wherein the at least two support sides are configured to selectively engage the footpad.

2. The exercise device of claim 1, wherein the cam is triangular and has three support sides, the distance between the axis and the third support side being different from the distance between the axis and at least one of the first and second support sides.

3. The exercise device of claim 1, wherein the cam has four support sides, the distances between the axis and each of the support sides being different.

4. The exercise device of claim 1, further comprising a knob connected to the cam that can be grasped in a user's hand to rotate the cam.

5. The exercise device of claim 1, wherein the footpad is pivotally connected to the link arm at or near the toe end of the footpad.

6. The exercise device of claim 1, wherein the footpad is pivotally connected to the link arm at or near the heel end of the footpad.

7. The exercise device of claim 1, wherein the footpad includes a support plate.

8. The exercise device of claim 1, wherein the footpad includes a slip resistance surface.

9. The exercise device of claim 1, further comprising a drive assembly that is mounted on the frame.

10. The exercise device of claim 9, wherein the footpads reciprocate along a fixed path or rotate about a closed loop during performance of an exercise.

11. The exercise device of claim 10, wherein the drive assembly includes a flywheel that rotates during performance of an exercise.

12. The exercise device of claim 9, wherein the drive assembly is mounted toward the forward end of the frame.

13. The exercise device of claim 9, wherein the drive assembly is mounted toward the rearward end of the frame.

14. The exercise device of claim 9, wherein the drive assembly is mounted between the forward and rearward ends of the frame.

15. An elliptical exercise device with an adjustable foot pad, the elliptical exercise device comprising:

a frame having a front end and a rearward end;

a drive assembly mounted on the frame, the drive assembly including a flywheel that is rotatable about a first axis;

a link arm connected to the drive assembly, the link arm being moveable during the performance of an exercise by a user;

a cam connected to the link arm, the cam having at least two support sides, the cam further being rotatable about a second axis, wherein the distance between the second axis and the at least two support sides is different; and a footpad having a toe end and a heel end, the footpad being pivotally connected to the link arm at one end and resting on a support side of the cam, wherein:

the footpad moves in an elliptical path as the flywheel rotates about the first axis; and the angle between the footpad and the link arm can be selectively varied by rotating the cam about the second axis to two or more different rotational positions where the footpad is resting on different support sides.

16. The exercise device of claim 15, further comprising a knob connected to the cam that can be grasped in a user's hand to facilitate rotation of the cam.

17. The exercise device of claim 15, wherein the drive assembly is mounted toward the forward end of the frame.

18. The exercise device of claim 15, wherein the drive assembly is mounted toward the rearward end of the frame.

19. The exercise device of claim 15, wherein the drive assembly is mounted between the forward and rearward ends of the frame.

20. An elliptical exercise device with an adjustable foot pad, the elliptical exercise device comprising:

a frame;

a drive assembly mounted on the frame, the drive assembly including a flywheel that is rotatable about a first axis;

a first link arm rotatably connected to the frame;

a second link arm having a forward end and a rearward end, wherein the forward end of the second link arm is rotatably connected to the first link arm and the rearward end of the second link arm is rotatably connected to the drive assembly;

a cam connected to the second link arm at a point between the forward end and rearward end of the second link arm, the cam having at least two support sides, the cam further being rotatable about a second axis, wherein the distance between the second axis and each of the at least two support sides is different; and a footpad having a toe end and a heel end, the footpad being pivotally connected to the second link arm at one end and resting on one of the at least two support sides of the cam, wherein:

the footpad moves in an elliptical path as the flywheel rotates about the first axis; and the angle between the footpad and the second link arm can be selectively altered by rotating the cam about the second axis such that the footpad rests on different support sides.

* * * * *